United States Patent [19]

Lindstrom

[11] Patent Number: 4,595,447

[45] Date of Patent: Jun. 17, 1986

[54] ARTICLE LABELING MACHINE

[75] Inventor: John W. Lindstrom, Newfield, N.Y.

[73] Assignee: Hi-Speed Checkweigher Co., Inc., Ithaca, N.Y.

[21] Appl. No.: 680,136

[22] Filed: Dec. 10, 1984

[51] Int. Cl.[4] ..... B65C 9/02; B65C 9/36

[52] U.S. Cl. ..... 156/364; 156/497; 156/542; 156/571; 156/DIG. 25; 156/DIG. 31; 156/DIG. 33; 156/DIG. 42

[58] Field of Search ..... 156/364, 542, 571, 572, 156/497, DIG. 25, DIG. 31, DIG. 33, DIG. 37, DIG. 42

[56] References Cited

U.S. PATENT DOCUMENTS

| | | | |
|---|---|---|---|
| 583,376 | 5/1897 | Hoppe | 156/572 |
| 805,887 | 11/1905 | Smith | 156/571 |
| 3,232,815 | 2/1966 | Klopfenstein et al. | 156/360 |
| 3,243,329 | 3/1966 | Anderegg | 156/571 |
| 3,329,550 | 7/1967 | Kucheck | 156/285 |
| 3,616,016 | 10/1971 | Dinter | 156/238 |
| 3,616,094 | 10/1971 | Navin et al. | 156/571 |
| 3,682,743 | 8/1972 | Cleary et al. | 156/384 |
| 3,729,362 | 4/1973 | French et al. | 156/542 |
| 3,736,208 | 5/1973 | Kraft et al. | 156/497 |
| 4,025,382 | 5/1977 | Del Rosso | 156/497 |
| 4,119,482 | 10/1978 | Bennett | 156/351 |
| 4,124,436 | 11/1978 | Pettis, Jr. et al. | 156/542 |
| 4,210,481 | 7/1980 | Wolff et al. | 156/357 |

*Primary Examiner*—Michael Wityshyn

*Attorney, Agent, or Firm*—Bean, Kauffman & Bean

[57] ABSTRACT

A bell-shaped vacuum foot subtends from a vertically extending tube to receive a printed label in a first orientation from the label dispenser which is located to one side of and at a higher elevation than a conveyor which is transporting articles to be labeled. The label carrying vacuum foot is moved laterally away from the dispenser through a downwardly smoothly curving diagonal path devoid of any abrupt directional changes. If required, the tube is simultaneously operated to rotate the label into a preselected second orientation as it is being lowered upon the article to be labeled. The vacuum foot thus moves through shorter distances and is better enabled to maintain the label in the intended placement orientation. The apparatus of the invention employs a lesser number of parts and performs the intended function in substantially lesser time compared to the mechanisms of the prior art.

8 Claims, 12 Drawing Figures

Fig. 1.
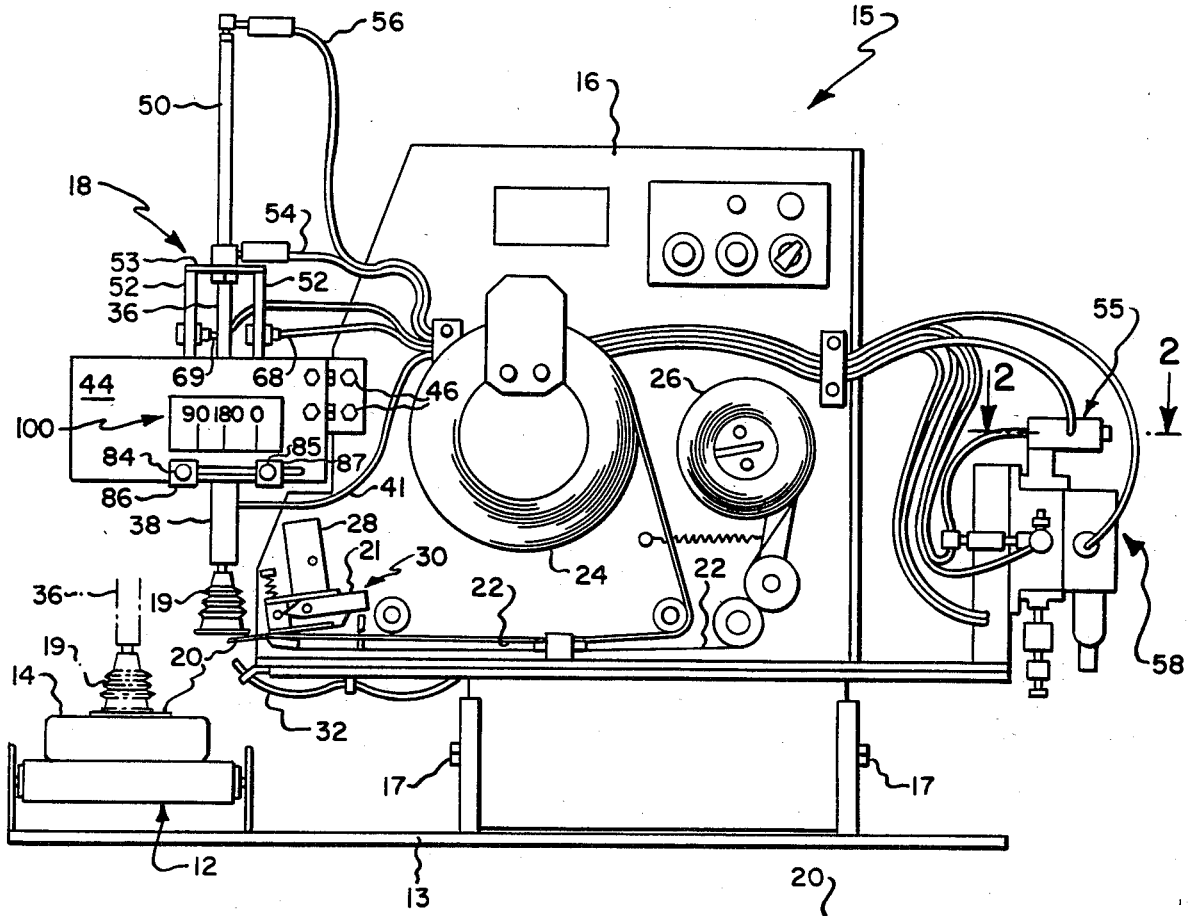
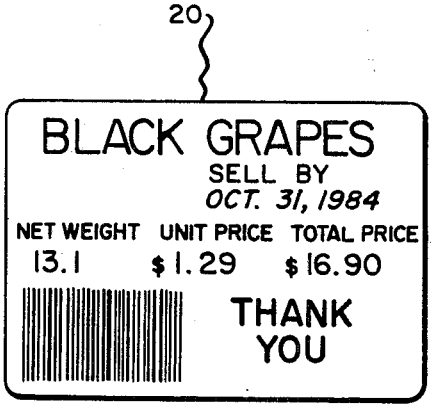
Fig. 1a.
Fig. 2.
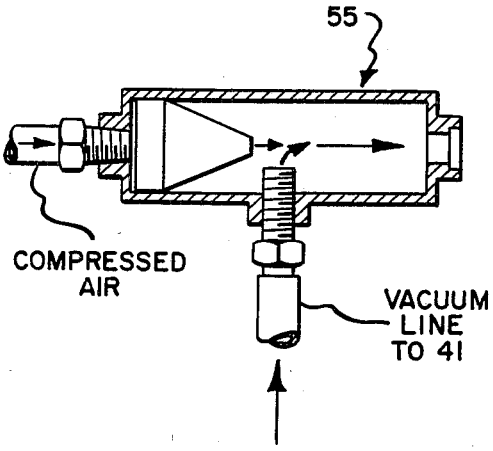

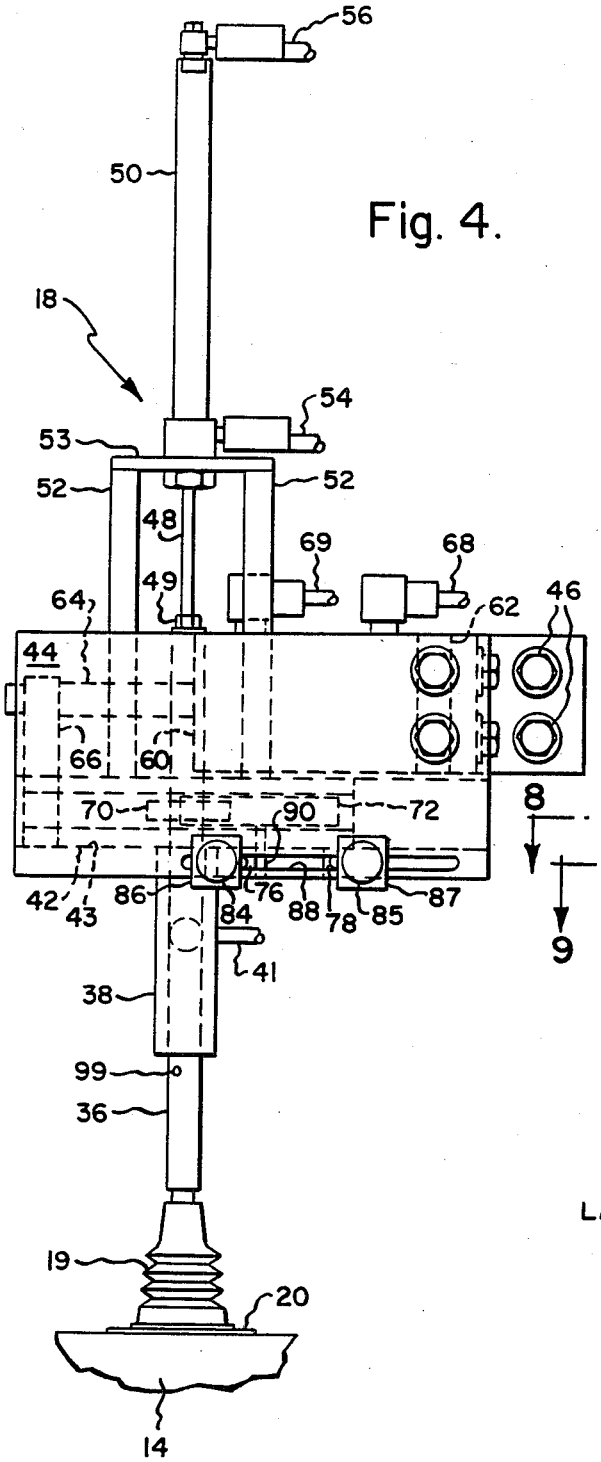
Fig. 4.
Fig. 3.
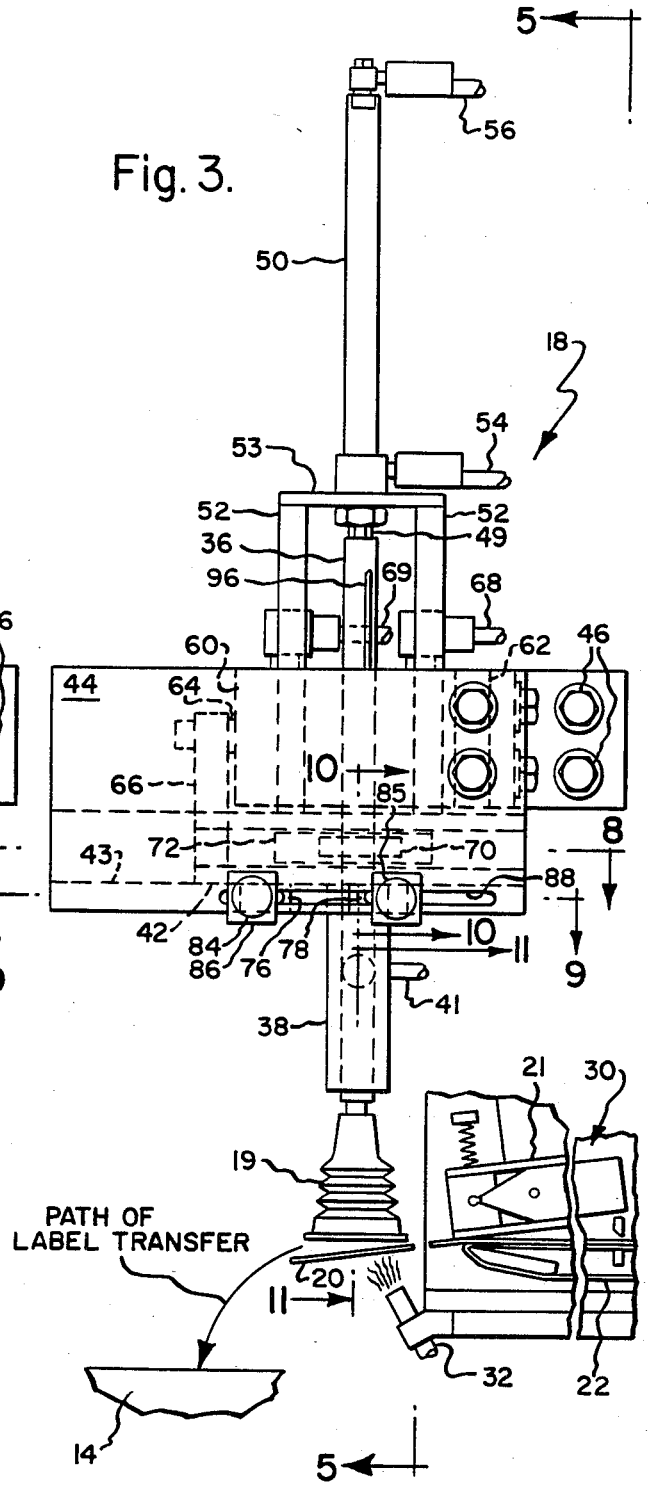

Fig. 5.
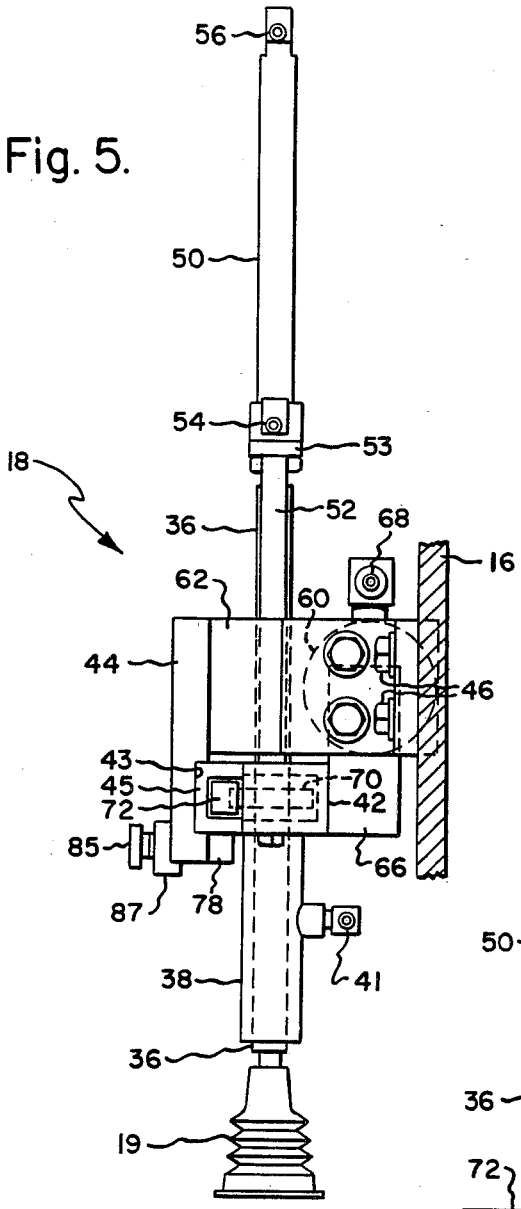
Fig. 6.
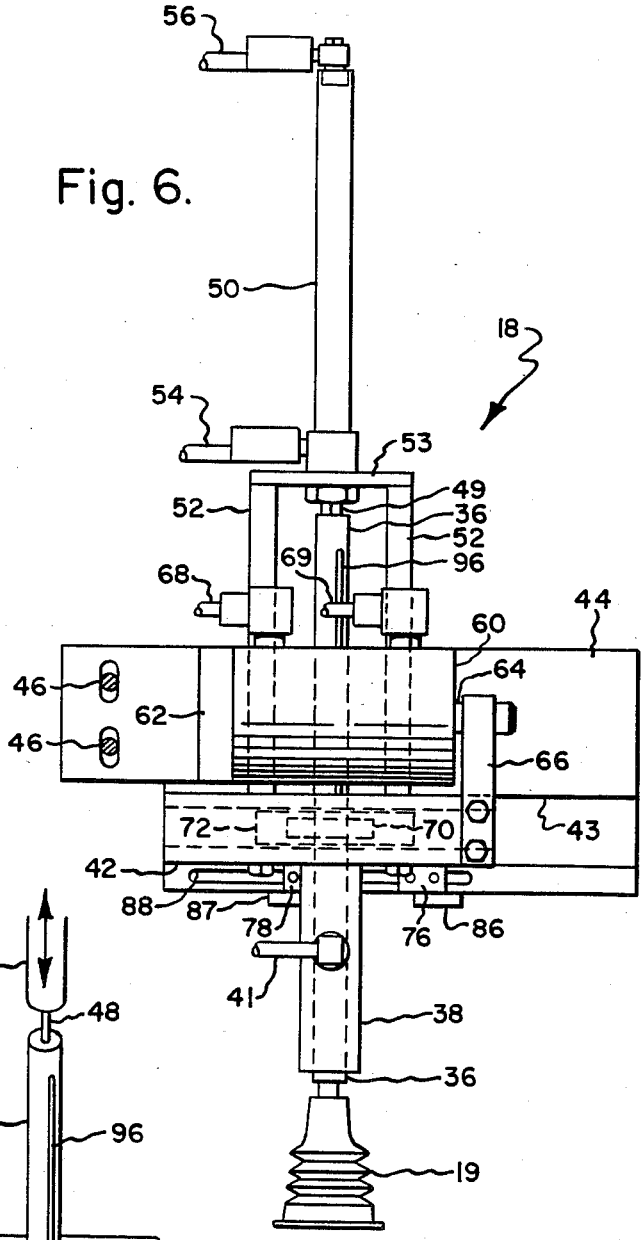
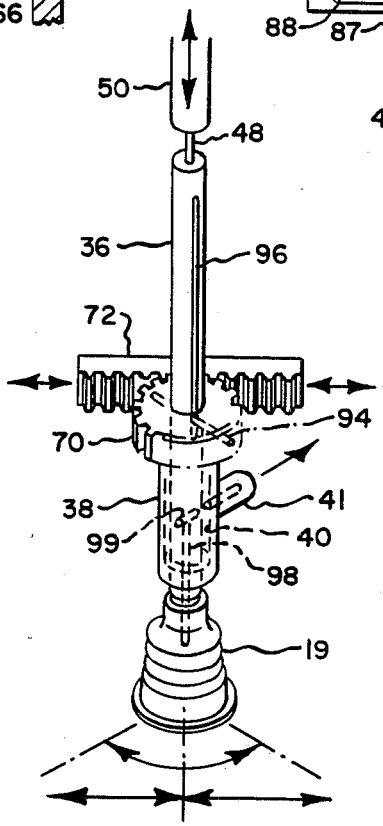
Fig. 7.

ARTICLE LABELING MACHINE

BACKGROUND OF THE INVENTION

The present invention relates to an automatic label applying machine and method. More specifically, it is directed to a printed label applying machine and method which rotates the labels before their application to the article in order to achieve a prescribed orientation of the printed material thereon, so as to comply for example with UPC label readout requirements. Prior type machines for such purposes are by way of example disclosed in U.S. Pat. Nos. 3,232,815; 3,329,550; 3,616,016; 3,682,743; 3,729,362 and 4,025,382. Such machines receive a label of a given printed orientation from a label dispensing device, and apply the label to an article in that same given orientation. This practice involves the disadvantage that the label is always placed by such machines on articles in the same orientation regardless of the orientation of the articles passing through the labeling station. Consequently, if for some production related reason the articles passing through the labeling station are oriented differently from the orientation of the label placed thereon, or if during a production run the article orientation is changed, all or some of the labels would be applied to the article in an orientation other than that which was preferred. In many cases, this is an undesirable or unacceptable result, the correction of which required an article reorientation station upstream of the labeling station.

Of more specific relevancy to the present invention is co-assigned U.S. Pat. No. 4,124,436 which provided a method and apparatus which increased the flexibility of the article labeling station itself, and which eliminated the need for an upstream article reorientation station, thereby reducing the cost and complexity of the production line. Such method and apparatus provided label rotation through one of a number of preselected angles prior to application to the article, so as to accommodate operation of the weighing and labeling station in accordance with any one of a number of prescribed article orientations. However, the present invention provides still further improvements in respect to the speed of operation and accuracy of the overall label orienting and applying system performance; as well as providing reductions in machine construction and maintenance costs.

BRIEF SUMMARY OF THE INVENTION

An improved apparatus and method is disclosed for picking up and rotating a printed label throughout any degree from 0° to 180°, and applying it in a prescribed orientation upon an article to be labeled. The label dispenser delivers the printed label to a bell-shaped rubber boot or vacuum foot which holds the label substantially parallel to the surface of the article upon which the label is to be placed, while the label-carrying foot is being carried laterally and at the same time rotated and vertically lowered towards the article to be labeled. Thus, the label is transported from the dispenser through a smoothly curving vertical arc (instead of by way of separated lateral and abruptly changing vertical motions); thereby ensuring against slippages of the label vis-a-vis the vacuum foot and providing consistent uniformity of label emplacements on the article in accordance with their prescribed orientations. This mode of label transfer accommodates printing of the next-in-line label during each prior label transfer process, whereby the next-in-line printed label is ready for transfer immediately upon return of the vacuum foot. Thus, the invention provides an overall improved high speed operation compared to the mechanisms of the prior art, including the referenced U.S. Pat. No. 4,124,436 without use of complicated and costly upstream accessory mechanisms, and is especially useful in the handling of "UPC" type or random printed labels, or the like.

BRIEF DESCRIPTION OF THE DRAWINGS

FIG. 1 is an elevational view showing a label applicator apparatus embodying the present invention;

FIG. 1*a* illustrates the format of a label of the type for which the apparatus of the invention is particularly adapted to handle;

FIG. 2 is an enlarged scale fragmentary sectional view of a vacuum generator auxiliary of the apparatus, taken as along the line 2—2 of FIG. 1;

FIG. 3 is a fragmentary elevational view showing the vacuum foot portion of the apparatus in its retracted label pickup position;

FIG. 4 is a view similar to that of FIG. 3, but shows the device in its label applying position;

FIG. 5 is a composite elevational and sectional view taken generally along the line 5—5 of FIG. 3;

FIG. 6 is an elevational view taken as along the line 6—6 of FIG. 5;

FIG. 7 is a fragmentary perspective view illustrating how means are provided for composite vertical reciprocating and rotating and lateral displacement movements of the label carrier incidental to transport from the label pickup to the label dispensing positions thereof;

DESCRIPTION OF THE PREFERRED EMBODIMENT

General Arrangement

Figure 8:
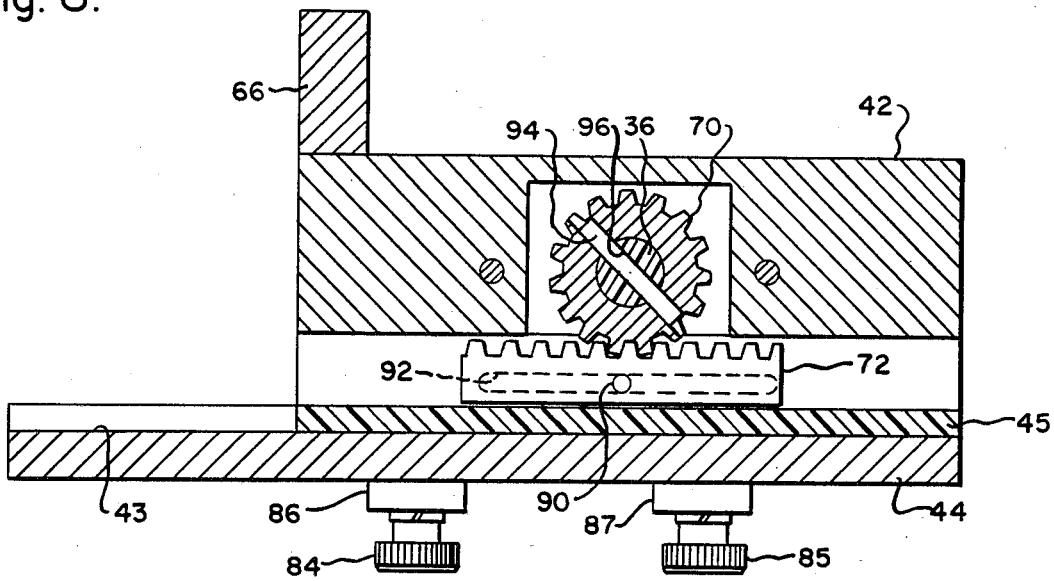
FIG. 8 is an enlarged scale cross-sectional view taken as along the line 8—8 of FIG. 3.

As shown at FIG. 1 by way of example, a continuously driven endless conveyor 12 mounted upon a base plate 13 serves to successively transport articles 14 underneath and through the labeling station. The term "article" as used herein refers to any type of object such as a bag-like package; or one of any box-like configuration having a planar label receiving surface; or articles having otherwise contoured or irregular upper surfaces such as may be on trays and covered by protective wrappers. In any case, the invention is adapted to deal with any "article" such as may have a suitable label receptive surface, and is particularly useful in handling labels showing the item title/price per pound/item weight and total price, such as the currently employed "UPC" type label. A facility for control of the label printer is shown generally at 15 (FIG. 1), and is shown as being carried on the machine frame 16 and may of course be of any suitable construction such as previously disclosed for example in U.S. Pat. No. 4,124,436. The frame 16 is arranged to be vertically adjustable relative to the base plate 13 such as by means of slide brackets and lock nuts 17,17, to enable the machine to handle runs of articles of different heights.

The label transfer and applicator mechanism of the present invention is designated generally at 18, and includes a vacuum foot 19 for carrying the label 20 away from the printed label dispenser 21 to the article 14 to be labeled. The labels 20 are of the type which have a pressure sensitive adhesive coated rear surface, permitting them to be furnished by and individually "peeled" away from a carrier tape 22 and then adhered directly onto a surface of the article 14. To this end, the machine frame 16 mounts a supply roll 24 from which carrier tape 22 bearing labels 20 is withdrawn. The emptied carrier tape 22 is then rewound upon a reel as shown at 26. The label printer is shown at 28.

The tape 22 carries the labels from the printer 28 to a label separator or "peeling" device 30 from which an appropriately printed label is to be applied to each of the articles arriving on the conveyor 12. The printing process is under control of the weighing and price computing apparatus 15 as explained for example in U.S. Pat. No. 4,124,436. Also as explained therein a preferred form of label separator device is provided, which employs a compressed air tube such as shown herein at 32 to ensure that the leading edge of the released label is properly disposed in substantially horizontal position for pickup by the vacuum foot 19. U.S. Pat. Nos. 4,025,382 and 4,124,436 show and describe in further detail the essentials and performances of such label transfer devices.

THE LABEL TRANSFER MECHANISM

Figure 10:
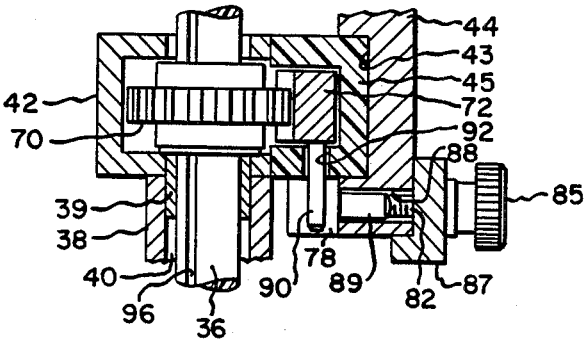
FIG. 10 is a fragmentary sectional view taken as along the lines 10—10 of FIGS. 3 and 9.

In the case of the present invention, the label transfer vacuum foot 19 depends from a vertically oriented hollow spindle 36 which is longitudinally reciprocal and carried within a tubular housing 38 by means of annular seals 39 (FIG. 11) thereby providing a closed end open cylindrical space 40 therebetween. The space 40 is arranged to be in open communication with a suitable vacuum source such as by means of a conduit connection 41. The housing 38 is fixed such as by welding to a bracket 42 which is of box-like cross-section (FIG. 10) and which is slidably mounted by means of a horizontal keyway 43 on a support plate 44 (FIGS. 5, 6 and 10). As shown at 45 (FIGS. 8 and 10), that portion of the box-shaped bracket 42 which slides in the keyway 43 is either formed of or is coated with a friction-reducing material. The plate 44 is initially adjustably positioned on the machine frame 16 as by means of bolts 46,46 (FIGS. 4, 5 and 6).

A piston rod 48 (FIGS. 4 and 7) is fixed to the upper end of the spindle 36 as shown at 49, and is enclosed within an air cylinder 50. The cylinder 50 is mounted on the bracket 42 by means of struts 52,52 which are based upon the bracket 42 and cross bar 53. Compressed air inlet/outlet conduits 54,56 connect into the air cylinder 50 at its opposite ends, thereby providing means for vertical reciprocations of the spindle 36 and the vacuum foot 19 under control of the valve system generally indicated at 58.

An air cylinder 60 is fixed upon the support plate 44 as by means of a bracket 62, and the piston rod 64 thereof extends through the opposite end of the cylinder 60 into connection with an arm 66 which is based upon the bracket 42 (FIGS. 3, 4 and 8). Compressed air conduits 68,69 connect into opposite ends of the cylinder 60 for alternate supply and return of air to and from opposite ends of the cylinder which is also under control of the valve system 58. Thus, the air cylinder 60 is operable to cause the bracket 42 to reciprocate laterally in sliding relation on the support plate 44, so as to transport the vacuum foot 19 back and forth between its label pickup and dispensing positions. Machines of this type are typically employed in association with "plug in" type electrical and compressed air power supply connection devices; and as shown at FIG. 2 herein, a compressed air supply device may, as an auxiliary to the present invention, be also employed to operate in accord with Bernoulli's principle to provide a suitable source of vacuum for connection to part 41.

As best shown at FIGS. 7–10, the spindle 36 carries a toothed wheel 70 which meshes in geared relation with a toothed rack member 72. The gear rack 72 is slidably carried within the box-shaped bracket 42 as best shown at FIGS. 8 and 10, between an internal side wall portion thereof and the wheel 70. Thus, the rack 72 is "caged" within the bracket 42 while at the same time being freely movable longitudinally therein so as to be operable to shuttle in lateral directions as viewed in FIGS. 3, 4, 6, 7, 8 and 9. Whereas the gear rack 72 is free to slide laterally within the bracket 42, shuttling movements thereof in accordance with the present invention are to be regulated within limits by the machine operator in accordance with varying requirements as to whether or not a label as picked up by the vacuum foot 19 is to be reoriented, and if so, to what degree, in order to provide for convenient customer viewing as well as to conform to "UPC" label readout requirements.

Figure 9:
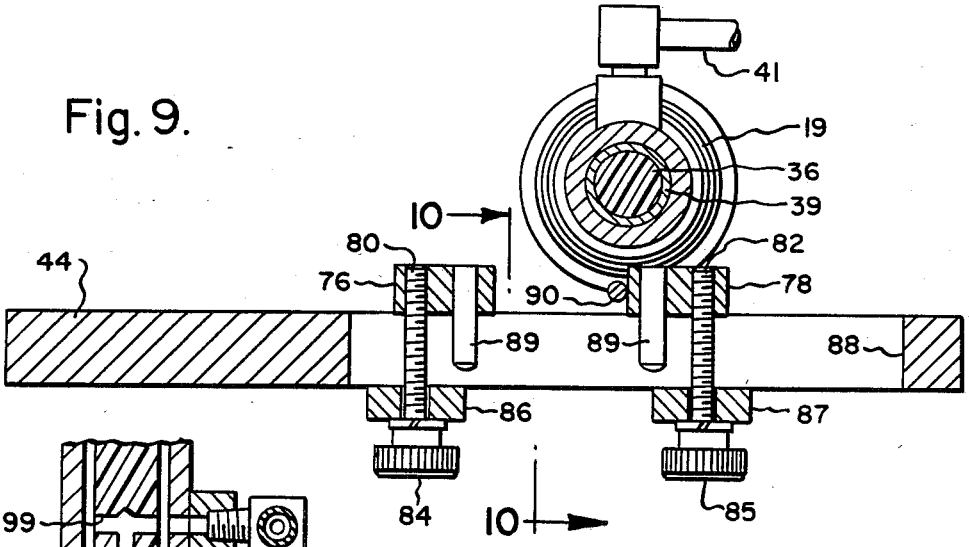
FIG. 9 is an enlarged cross-sectional view taken as along the line 9—9 of FIG. 3.

The shuttling operations of the rack 72 are controlled by machine operator manual settings of the rack movement limiting stop devices 76,78 (FIGS. 9 and 10). The blocks 76,78 are bored and tapped so as to accommodate in screw threaded relation therein threaded bolts 80,82 which are knurl-headed as shown at 84,85 (FIGS. 1, 3, 4, 5, 8, 9 and 10) to provide for convenient operator control settings of the shuttle action. The screw heads 84,85 bear against washers 86,87 which are thus mounted in opposition to the stop blocks 76,78 carried at opposite sides of the support plate 44. The screws 80,82 extend through a longitudinal slot 88 in the support plate (FIGS. 3, 4 and 9), whereby when the wheel-like heads 84,85 are rotated so as to tighten the stop blocks 76,78 and the washers 86,87 against opposite sides of the plate 44, the stop blocks are thus locked in position upon the plate 44. However, upon loosening of the control wheels 84,85 they may then be manually shifted in sidewise directions so as to correspondingly shift the stop blocks 76,78 relative to the slot 88 in the plate 44.

As best shown at FIGS. 8, 9 and 10, a rack shuttle control pin 90 extends downwardly from the gear rack 72 through a slot 92 in the bottom of the bracket 42 and into the lateral space between the stop blocks 76,78. Thus, positioning of the blocks 76,78 on the plate 44 control the shuttling of the rack 72. Pins 89,89 extend from the stop blocks 76,78 into the slot 88 in radially offset relation from the screws 80,82 to stabilize the blocks 76,78 against rotation incidental to loosening and tightening operations of the control wheels 84,85. Thus, the timing of the start/stop rotating operations of the spindle 36, as well as the degree thereof in either angular direction, is regulatable by positionings of the control wheels 84,85.

THE LABEL PICKUP AND DISPENSING OPERATION

Figure 11:
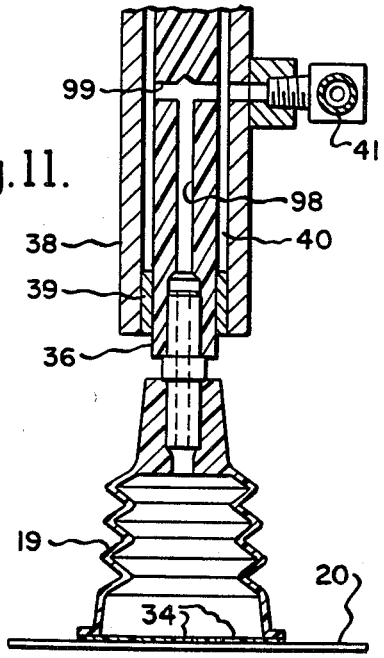
FIG. 11 is a fragmentary sectional view taken as along the line 11—11 of FIG. 3.

As best shown at FIGS. 6, 7 and 11, the spindle 36 is vertically reciprocal under control of the air cylinder 50 in the housing 38, and is keyed to rotate with the gear wheel 70 by means of a pin 94 which rides in a vertically through-slotted portion 96 of the upper end of the spindle 36. Thus, the air cylinder 50 is free to vertically reciprocate the spindle 36, while at the same time the rack 72 (by means of the gear wheel 70) is causing the spindle to rotate. As best shown at FIGS. 7 and 11, the spindle 36 at its lower end is hollowed as shown at 98, so as to be in vacuum communication with the connection 41 and with the label pickup shoe 19. Thus, when the spindle 36 is in its upwardly retracted position, the vacuum source is operative to create the label pickup and holding facility throughout the smoothly curving label transfer path as shown at FIG. 3. A side wall portion of the spindle 36 is bored as shown at 99 (FIG. 4), at such location thereon that when the boot 19 comes into contact with the article 14, the port 99 emerges below the housing 38 as shown at FIG. 4. Hence, the vacuum foot label holding force is then neutralized by entrance of ambient air through the port 99, thereby releasing the label into pressed down adhesive attachment to the article. At that time, operations of the air cylinders 50 and 60 are reversed by the valve control systems at 58, returning the pickup shoe 19 in a similarly shortened upwardly and laterally curving path to the label dispenser.

Thus, it will be appreciated that in the case of the present invention labels are carried from the dispenser for application to the designated articles by the label transfer shoe while traveling (compared to prior art machines) a substantially shorter distance in a smoothly curving line path as shown at FIG. 3, instead of sequentially through abruptly changing horizontal and vertical connecting paths. The path of return of the shoe for pickup of the next label is similarly shortened. Hence, the overall operation requires the shoe to be moved through lesser distances compared to systems of the prior art whereby the time necessarily consumed in each cycle of the operation is substantially reduced. Also, because the shoe carries the label in a constantly curving path with no abrupt directional change while continuously pressing down upon the label against the vacuum effect acting in opposition thereto, the attachment of the label to the shoe is much more secure than is provided by any somewhat similar devices of the prior art.

It is therefore readily apparent that the apparatus of the present invention may be more economically and successfully operated in fail-proof manner at substantially higher rates of speed. Furthermore, because of the structural simplicity of the apparatus of the invention and its versatile adjustabilities for working on product line articles of various measurements and forms requiring different label orientations, it is evident that the invention provides an important advance in the art. Prior mechanisms for rotating such labels during transfer were operationally limited by parameters within which such limitations do not apply to the present invention.

What is claimed is:

1. A labeling machine of the type comprising in combination, a base support (16) and a high speed operating conveyor (12) adapted to carry a succession of articles (14) each of which is to be labeled as it arrives at a labeling station with an appropriately printed label (20) carrying previously ascertained marketing information(s) specifically applicable to each such article, said machine including a printed label dispenser means (30) located on said support to one side of and at an elevation above said conveyor for dispensing in sequence and in horizontally flat-wise attitude labels having pressure sensitive adhesive on one side and with appropriate marketing information(s) printed on the other side in a standard orientation readout relationship to the vertical axes of said labels; said machine having an improved carrying means for transferring such printed labels to such articles and applying them to the article to be labeled; said carrying means comprising:

label pickup means operable for temporary attachment to the first in line of said labels as presented by said dispenser means and for transporting said labels while in flat-wise attitude throughout a smoothly curving composite horizontally sidewise and vertically descending path, and then depositing said labels on said articles as they pass through said labeling station, whereafter said pickup means returns to said dispenser means while traveling in a similar diagonally curving path, said pickup means comprises a support plate (44) mounted on said base support (16) for horizontal sliding movements thereon; a vertically standing hollow tube (36) carried by said plate (44) in vertically slidable relation thereon; a vacuum shoe (19) at the base of said tube; means (60) for causing said support plate to reciprocate relative to said base support in horizontal directions; means (50) for causing said tube to reciprocate in vertical directions; means (58) for causing said tube to be displaced simultaneously laterally and vertically in smoothly curving arcuate paths between the positions of said dispenser means and the articles to be labeled; and a vacuum source connected into communication with the interior of said tube for holding said labels to said shoe during transports thereof.

2. A labeling machine as set forth in claim 1 wherein said means for causing said tube to be displaced laterally and vertically comprise pressurized air piston-cylinder devices.

3. An apparatus for transferring a horizontally flat-wise presented label from a label dispenser to an article to be labeled which is situated at a lower level and in sidewise displaced position relative to said dispenser, said apparatus comprising:

a vacuum shoe carried at the bottom end of a vertically extending tube which is connected to a vacuum source and is vertically reciprocal in a housing member, said tube having an apertured side wall portion thereof which is normally vacuum sealed by said housing but is exposed to ambient atmosphere when said tube is in its lowermost extended position relative to said housing;

means for shifting said tube carrying housing laterally back and forth between label pickup and label applying positions; and means for simultaneously causing said tube to move downwardly within said housing when traveling away from said label dispenser to said label applying position, whereby said vacuum foot is enabled to carry a label in a laterally and downwardly smoothly curving path toward the article to be labeled and whereby upon arrival at said label applying position said apertured tube portion is exposed to intake air at ambient atmospheric pressure operative to break the vacuum and release the label from said shoe for adhesive attachment to said article.

4. A labeling machine of the type comprising in combination a high speed operating conveyor adapted to carry a succession of articles each of which is to be labeled as it arrives at a labeling station with an appropriately printed label carrying previously ascertained marketing information(s) specifically applicable to each such article, said machine including a printed label dispenser means located to one side of and at an elevation above said conveyor dispensing in sequence and in horizontally flat-wise attitude labels having pressure sensitive adhesive on one side and with appropriate marketing information(s) printed on the other side in a standard orientation readout relationship to the vertical axes of said labels; said machine having an improved carrying means for transferring such printed labels to such articles and applying them thereto in any preferred readout vertical axis orientation relative to the article to be labeled; said carrying means comprising:

pickup means operable for temporary attachments in succession to the first in line of said labels presented by said dispenser means, and for transporting said labels while in flat-wise attitude throughout a smoothly curving composite horizontally sidewise and vertically descending path, and then depositing said labels on said articles as they pass through said labeling station, said pickup means comprises a vacuum shoe depending from a hollow spindle, and rack and pinion gear means is provided for rotating said spindle about the vertical axes of said labels while being transferred, whereby to deliver said labels to said articles in an angularly adjusted readout position compared to the standard readout orientation of said labels when picked up from said dispenser means.

5. A machine as set forth in claim 4 wherein the rotation control movements of said rack are operator controllable by manual adjustments of displacement stop devices.

6. A labeling machine of the type comprising in combination a high speed operating conveyor adapted to carry a succession of articles each of which is to be labeled as it arrives at a labeling station with an appropriately printed label carrying previously ascertained marketing information(s) specifically applicable to each such article, said machine including a printed label dispenser means located to one side of and at an elevation above said conveyor for dispensing in sequence and in horizontally flat-wise attitude labels having pressure sensitive adhesive on one side and with appropriate marketing information(s) printed on the other side in a standard orientation readout relationship to the vertical axes of said labels; said machine having an improved carrying means for transferring such printed labels to such articles and applying them thereto in any preferred readout vertical axis orientation relative to the article to be labeled; said carrying means comprising:

pickup means operable for temporary attachments in succession to the first in line of said labels presented by said dispenser means, and for transporting said labels while in flat-wise attitude throughout a smoothly curving composite horizontally sidewise and vertically descending path, and then depositing said labels on said articles as they pass through said labeling station, said pickup means comprises a stationary means, a support plate mounted on said stationary means for horizontal reciprocating movements relative thereto, a vertically standing hollow tube carried by said support plate for vertically reciprocating and axial rotational movements relative thereto, a vacuum shoe carried by a lower end of said tube, means for reciprocating said support plate relative to said stationary means and said tube relative to said support plate for causing said vacuum shoe to be displaced simultaneously laterally and vertically in smoothly curving arcuate paths between the positions of said dispenser means and the articles to be labeled, a vacuum source connected into communication with the interior of said tube for holding said labels to said vacuum shoe during transport thereof, and means for selectively and adjustably effecting rotational movements of said tube relative to said support plate.

7. A machine according to claim 6, wherein said means for selectively and adjustably effecting rotational movements of said tube additionally includes a pinion gear fixed for rotation with said tube, a rack engaged with said pinion gear and slidably supported by said support plate for reciprocating movements in alignment with said movements of said support plate relative to said stationary means, and means adjustably mounted on said stationary means for engagement with said rack.

8. A machine according to claim 6, wherein said tube is partially enclosed within a housing carried by said support plate and said tube has an apertured portion normally vacuum sealed by said housing, but exposed to ambient atmosphere when said vacuum shoe is in a lowermost label depositing position thereof for breaking the vacuum applied to said vacuum shoe and thereby releasing said lable from said vacuum shoe for adhesive attachment to said article.

* * * * *

UNITED STATES PATENT AND TRADEMARK OFFICE

CERTIFICATE OF CORRECTION

PATENT NO. : 4,595,447

DATED : June 17, 1986

INVENTOR(S) : John W. Lindstrom

It is certified that error appears in the above-identified patent and that said Letters Patent are hereby corrected as shown below:

Col. 2, lines 26 and 27 - should read -- Fig. 6 is a rear elevational view of the apparatus shown in Fig. 3; --

Col. 6, line 19 - after "said", insert -- label --.

Col. 7, line 9 - after "conveyor", insert -- for --.

Signed and Sealed this

Fourth Day of November, 1986

[SEAL]

*Attest:*

DONALD J. QUIGG

*Attesting Officer*

*Commissioner of Patents and Trademarks*